US008413264B1

(12) United States Patent
Harrold

(10) Patent No.: US 8,413,264 B1
(45) Date of Patent: Apr. 9, 2013

(54) GRIPPING COMPRESSION GLOVE AND METHOD

(76) Inventor: Sandra L. Harrold, North Fort Myers, FL (US)

( * ) Notice: Subject to any disclaimer, the term of this patent is extended or adjusted under 35 U.S.C. 154(b) by 235 days.

(21) Appl. No.: 12/764,940

(22) Filed: Apr. 21, 2010

Related U.S. Application Data

(60) Provisional application No. 61/171,149, filed on Apr. 21, 2009.

(51) Int. Cl.
*A41D 19/00* (2006.01)

(52) U.S. Cl. ..... 2/161.1; 2/162

(58) Field of Classification Search ..... 2/159, 161.1, 2/161.2, 161.3, 161.4, 161.7, 161.8, 160, 2/161.6, 162, 16, 18, 20, 167; 602/21, 22, 602/61–64

See application file for complete search history.

(56) References Cited

U.S. PATENT DOCUMENTS

| | | | | | |
|---|---|---|---|---|---|
| 3,597,765 | A | | 8/1971 | Stanton | |
| 4,084,586 | A | * | 4/1978 | Hettick | 602/60 |
| 4,281,647 | A | * | 8/1981 | Antypas | 602/21 |
| 4,843,651 | A | | 7/1989 | Gramza | |
| 4,881,276 | A | | 11/1989 | Swan | |
| 4,905,321 | A | * | 3/1990 | Walunga | 2/161.1 |
| 5,033,119 | A | | 7/1991 | Wiggins | |
| 5,197,149 | A | | 3/1993 | Overton | |
| 5,370,606 | A | * | 12/1994 | Martel et al. | 602/64 |
| 5,376,066 | A | * | 12/1994 | Phillips et al. | 602/21 |
| 5,498,234 | A | * | 3/1996 | Martel et al. | 602/64 |
| 5,500,956 | A | | 3/1996 | Schulkin | |
| 5,517,694 | A | | 5/1996 | Fabry | |
| 5,527,244 | A | * | 6/1996 | Waller et al. | 482/47 |
| 5,538,501 | A | | 7/1996 | Caswell | |
| 5,581,809 | A | * | 12/1996 | Mah | 2/20 |
| 5,735,807 | A | * | 4/1998 | Cropper | 602/63 |
| 5,802,614 | A | | 9/1998 | Melone | |
| 5,867,832 | A | * | 2/1999 | Liu | 2/161.7 |

(Continued)

OTHER PUBLICATIONS

Mueller Sports Medicine, Inc; Mueller Product Catalog 2007-2008; date unknown; 61 pdf pages. Possibly relevant pages includes p. 39 (pdf p. 41).

(Continued)

*Primary Examiner* — Amy Vanatta

(74) *Attorney, Agent, or Firm* — Avery, Whigham & Winesett, PA; Nathan Stamey Winesett

(57) ABSTRACT

A glove 10 having a palmar side 20 and a dorsal side 30 comprising a compress material 14 configured to enclose and compress at least a portion of a hand, and a gripping surface 18 on at least a portion of the palmar side of the glove. The glove can further comprise a wrist support 22 configured to support a wrist attached to the hand. The wrist support can include a length of strap material 26 sufficient to wraparound the wrist such that the strap material is at least partially overlapping, and can also include a means for affixing the strap material in a wrapped position.

A method for therapeutically supporting a hand and a wrist and providing a means to grip an object, comprising the steps of compressing at least a portion of the hand with a compress material 14; and affixing a gripping surface 18 to the compress material. The method can further comprise the step of supporting the wrist with a length of strap material 26 sufficient to wraparound the wrist, such that the strap material is at least partially overlapping, and has a means for affixing the strap material in a wrapped position.

1 Claim, 4 Drawing Sheets

U.S. PATENT DOCUMENTS

| | | | | |
|---|---|---|---|---|
| 6,013,044 | A | 1/2000 | Estwanik | |
| 6,029,277 | A | 2/2000 | Picchione, II | |
| 6,093,165 | A | 7/2000 | Estwanik | |
| 6,098,199 | A | 8/2000 | Barkin | |
| 6,135,974 | A * | 10/2000 | Matz | 602/62 |
| 6,209,138 | B1 | 4/2001 | Kang | |
| 6,253,382 | B1 | 7/2001 | Kleinert | |
| 6,694,523 | B2 * | 2/2004 | Hurst | 2/161.7 |
| 7,000,253 | B1 | 2/2006 | Kleinert | |
| 7,000,256 | B2 | 2/2006 | Kleinert | |
| 7,211,004 | B2 | 5/2007 | DeMarco | |
| 7,234,172 | B1 | 6/2007 | Hoelscher | |
| D549,886 | S | 8/2007 | Kleinert | |
| 7,464,446 | B2 | 12/2008 | Johansson | |
| 2002/0029401 | A1 * | 3/2002 | McEvoy | 2/161.7 |
| 2004/0199978 | A1 | 10/2004 | Cass | |
| 2007/0276310 | A1 * | 11/2007 | Lipshaw et al. | 602/62 |
| 2008/0196142 | A1 | 8/2008 | Getzwiller | |
| 2010/0312160 | A1 * | 12/2010 | Creighton et al. | 602/62 |
| 2011/0030122 | A1 * | 2/2011 | Capurro | 2/162 |

OTHER PUBLICATIONS

Totes>>Isotoner Corp.; http://www.totes-isotoner.com/product/isotoner/therapeutic+gloves/compression+gloves/full+finger+therapeutic+gloves.do?sortby=ourPicks; date unknown, 1 page.

* cited by examiner

GRIPPING COMPRESSION GLOVE AND METHOD

CROSS-REFERENCE TO RELATED APPLICATIONS

This application claims the benefit of U.S. Provisional Patent Application Ser. No. 61/171,149, filed Apr. 21, 2009 by Sandra L. Harrold.

BACKGROUND OF THE INVENTION

1. Field of the Invention

The present invention relates generally to a device and method for providing relief and support to the hand and wrist during activities. More particularly, the present invention relates to a therapeutic glove and method.

2. Related Art

Gloves are used in many sports to provide comfort, protect the hands, provide improved grip, prevent or reduce blistering, and absorb shock. Some examples of such gloves are tennis gloves, baseball batting gloves, and golf gloves. Such gloves are often made of cabretta leather, or other leathers or synthetic leathers having a soft, tacky, flexible, and non-bulky nature for providing good grip, comfort, and feel.

Some activities, such as tennis, are difficult for persons with having certain ailments of the hand and wrist. For example, arthritis, tendinitis, and pain and weakness associated with carpal tunnel surgery can inhibit a person's ability to participate in such activities. Person's with such ailments often alleviate their symptoms by compressing and providing support to the region. However, the means for accomplishing this are often bulky and cumbersome and lacking in some features of performance athletic gloves.

SUMMARY OF THE INVENTION

It has been recognized that it would be advantageous to develop a device and method for providing compression to the hand and providing a gripping surface for use in connection with activities such as tennis or golf. It has further been recognized that it would be advantageous to develop a device and method also providing compression and support to the wrist.

The invention provides a glove and method, said glove having a palmar side and a dorsal side, said glove comprised of a compress material, which is configured to enclose and compress at least a portion of a hand, and a gripping surface on at least a portion of the palmar side of the glove. In another embodiment, the glove further comprises a wrist support configured to support a wrist attached to the hand.

The compress material can be configured to enclose and compress all surface tissues of the hand. The compress material can also extend beyond a wrist attached to the hand. This extended compress material can be configured to enclose and compress the wrist. The compress material can be further configured to cause compression of the surface tissues of the hand and/or wrist at a pressure of about 23-32 mm Hg. In one embodiment, the compress material is comprised of nylon and spandex. In one such embodiment, the spandex used is LYCRA™ spandex. In a more detailed embodiment, the compress material is comprised of approximately 80% nylon and 20% spandex. The compress material can also be configured to provide compression to the surface tissues along multiple axes of the compress material. For example, the compress material can be configured to stretch and compress both longitudinally and latitudinally.

The gripping surface can be comprised of a leather or a synthetic leather. The gripping surface can be comprised of a material having tacky, soft, flexible, and non-bulky characteristics. In one embodiment, the gripping surface is comprised of cabretta leather. In another embodiment, the gripping surface can cover the entire palmar side of the hand. In another embodiment, the gripping surface can be affixed to and over the compress material.

In some embodiments, the glove can have a multi-handed configuration to accommodate a person wearing the glove on either a right or a left hand. Such embodiments can have a gripping surface on both the palmar and dorsal sides of the glove.

In embodiments having a wrist support, the wrist support can include a length of strap material sufficient to wraparound the wrist such that the strap material is at least partially overlapping, and also includes a means for affixing the strap material in a wrapped position. In one embodiment, the strap material is comprised of a neoprene blend configured to be elastic along the latitudinal axis. In such embodiments, the longitudinal axis of the strap material can be configured to have little or no elasticity. The strap material can also be configured to be adjustably tightened along the latitudinal axis. The length of the strap material can be equal to or greater than about 7 inches. In one embodiment, the length of the strap material is about 11 inches. The width of the strap material can be equal to or greater than about 1 inch. In one embodiment, the width of the strap material is about 2 inches.

The invention also provides a method for therapeutically benefitting a hand and providing a means to grip an object, comprising the steps of 1) compressing at least a portion of the hand with a compress material and 2) affixing a gripping surface to the compress material. The invention can further provide for the step of supporting the wrist with a length of strap material sufficient to wraparound the wrist, such that the strap material is at least partially overlapping, and has a means for affixing the strap material in a wrapped position.

Additional features and advantages of the invention will be apparent from the detailed description which follows, taken in conjunction with the accompanying drawings, which together illustrate, by way of example, features of the invention.

DETAILED DESCRIPTION

Figure 1:
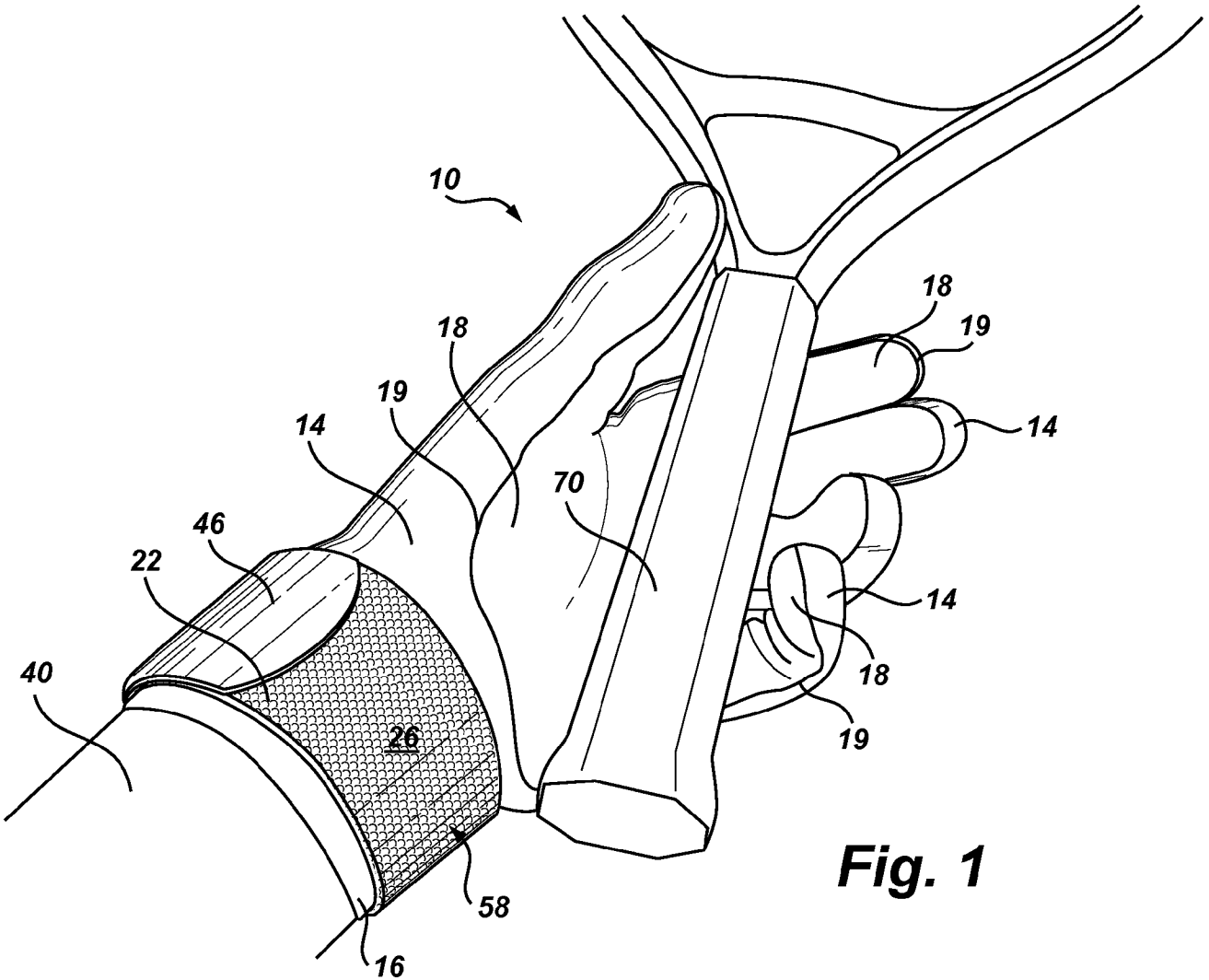
FIG. 1 is a palmar perspective view of a glove worn and used by a person in accordance with an embodiment of the present invention, showing a person beginning to grip an object with the gripping surface of the glove.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As used herein, "hand" refers to the whole hand including the fingers and thumb unless the discussion states otherwise or the context clearly indicates otherwise. "Palmar" refers to the palm side of the glove, i.e. the side of the glove that includes the portion that would cover the palm of a person wearing the glove. "Dorsal" refers to the side of the glove opposite of the "palmar" side, i.e. the side of the glove that includes the portion that would cover the back of the hand of a person wearing the glove.

Figure 2:
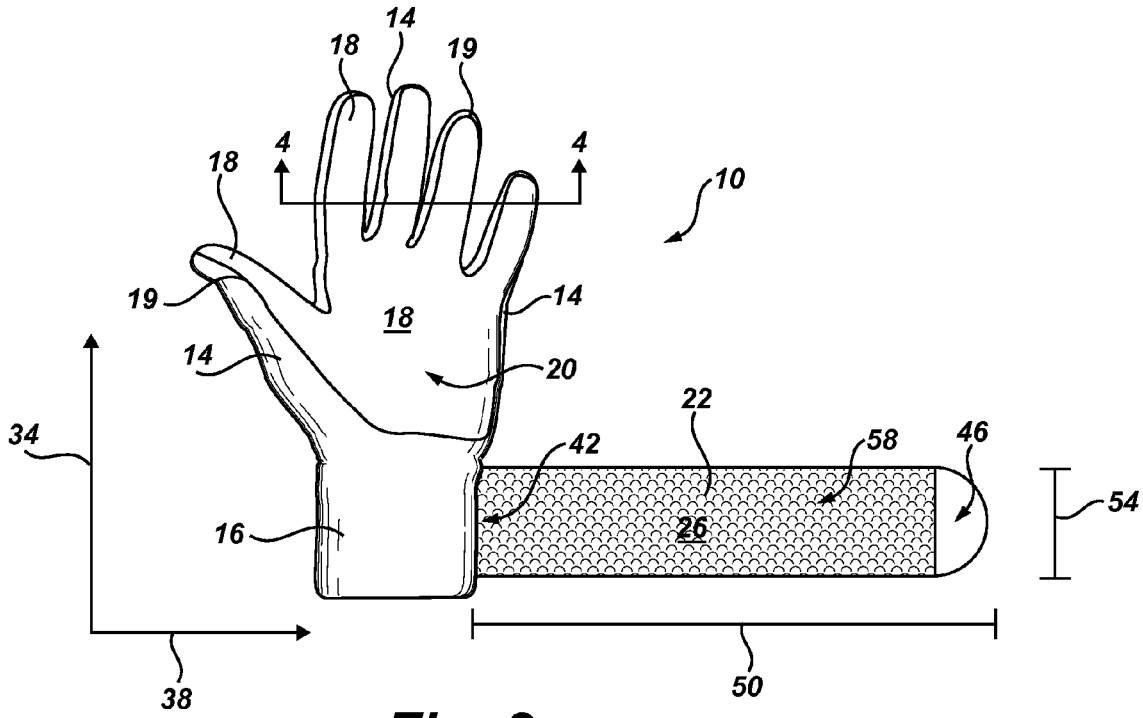
FIG. 2 is a slightly perspective palmar view of a glove in accordance with an embodiment of the present invention.
Figure 3:
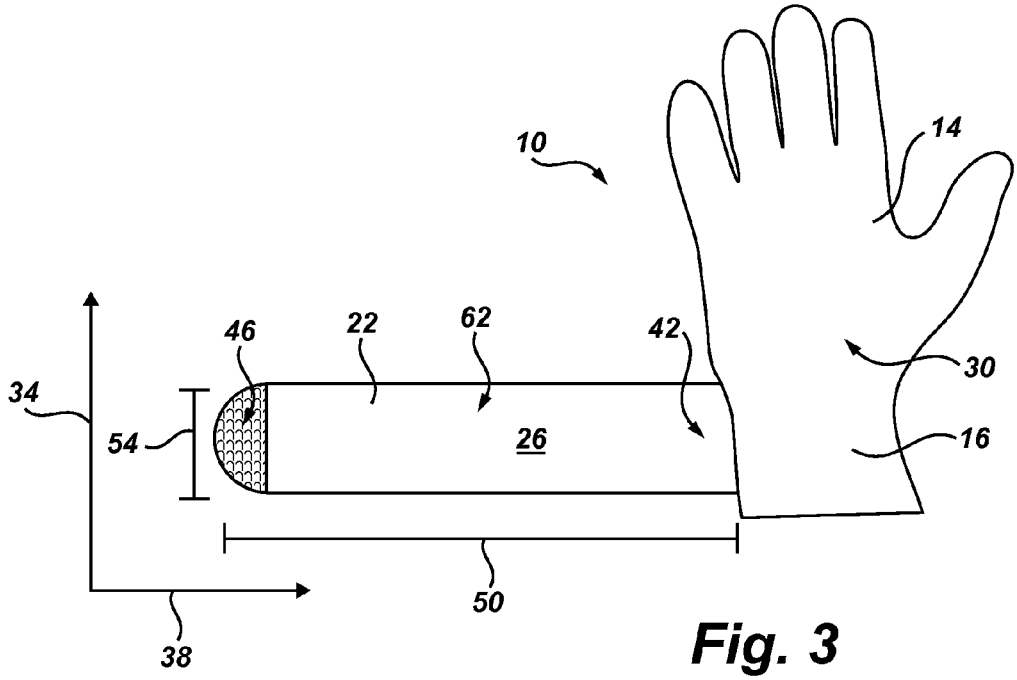
FIG. 3 is a dorsal view of the glove of FIG. 2.

As illustrated in the Figures, a glove, indicated generally at 10, having a palmar side, indicated generally at 20 in FIG. 2, and a dorsal side, indicated generally at 30 in FIG. 3, in accordance with the present invention is shown. The glove can be comprised of a compress material 14, which is configured to enclose and compress at least a portion of a hand, and a gripping surface 18 on at least a portion of the palmar side of the glove. In another embodiment, the glove can further comprise a wrist support 22 configured to support a wrist attached to the hand.

The compress material 14 can be configured to compress the hand and/or wrist for providing relief to a person, indicted generally at 40 in FIG. 1, wearing the glove 10. This compression of the hand and/or wrist may provide a person wearing the glove with some therapeutic relief. For example, the compression of the soft tissue of the hand and/or wrist may reduce pain and swelling, help retain warmth to the region, may improve blood circulation, may help with numbness and tingling issues, and may provide a massaging action with the stretch and compression of the compress material during hand and wrist movements. Such benefits may provide some persons with therapeutic relief for some of the symptoms associated with arthritis, tendinitis, carpal tunnel syndrome, post-carpal tunnel surgery issues, and hand fatigue.

The gripping surface 18 may provide a person wearing the glove 10 with an improved grip and feel of objects 70 held by the hand of a person 40 wearing the glove. By including a gripping surface, the invention can provide some of the features of performance athletic gloves while also providing the benefits of compression. The gripping surface can be comprised of materials known in the art that are beneficial for performance athletic gloves, such as those materials that are suitable for tennis gloves, gloves for other racquet sports, golf gloves, or baseball gloves. As such, the gripping surface can be configured with materials conducive to holding and gripping a racquet, a baseball bat, a golf club, or other objects.

Additionally, the invention can include a wrist support 22 configured to support a wrist attached to the hand of a person 40 wearing the glove. The wrist support can be configured to provide compression to the wrist for providing some or all of the benefits of compression. The wrist support can also be configured to provide compression to the nearby regions of the arm and hand. The compression provided by the wrist support can be configured to be adjustably increased or decreased. The wrist support can be configured to adjustably increase or decrease support to the wrist. The wrist support can help support and stabilize a weak or injured wrist. The wrist support may also help prevent wrist injuries. The wrist support can also be configured to provide full or nearly full range of movement of a wrist joint so that wearing a glove in accordance with the invention does not interfere with activities.

The compress material 14 can be configured to enclose and compress all surface tissues of the hand. For example, as shown in FIGS. 1-3, 6, and 7, the compress material can be configured into a full-fingered glove enclosing and compressing the entire hand, including the full length of the fingers and thumb. In some embodiments, the compress material may enclose only certain portions of the hand and/or wrist. For example, the compress material can be configured into a partial-finger glove such that the fingertips or some other length of the ends of a person's fingers are left exposed.

As shown in FIGS. 1-3, 5, 6, and 7, the compress material 14 can also extend beyond a wrist attached to the hand. This extended compress material, indicated generally at 16, can be configured to enclose and compress the wrist. While this extended compress material can provide benefits of compression, it can also serve as a comfortable liner between a person's wrist and the wrist support.

The compress material 14 can be configured to compress the hand and/or wrist of a person wearing the invention at various pressures of compression. The compress material can be configured to cause compression of the surface tissues of the hand and/or wrist at a pressure equal to or greater than about 5 mm Hg. The compress material can be configured to cause compression of the surface tissues of the hand and/or wrist at a pressure equal to or greater than about 10 mm Hg. The compress material can be configured to cause compression of the surface tissues of the hand and/or wrist at a pressure equal to or greater than about 15 mm Hg. The compress material can be configured to cause compression of the surface tissues of the hand and/or wrist at a pressure equal to or greater than about 20 mm Hg. The compress material can be configured to cause compression of the surface tissues of the hand and/or wrist at a pressure equal to or greater than about 25 mm Hg. The compress material can be configured to cause compression of the surface tissues of the hand and/or wrist at a pressure equal to or greater than about 30 mm Hg. The compress material can be configured to cause compression of the surface tissues of the hand and/or wrist at a pressure of about 23-32 mm Hg. The compress material can be configured to cause compression of the hand and/or wrist at a pressure between 8-45 mm Hg.

The compress material 14 can be comprised of stretch fabrics having elastic characteristics such that the material can compress the hand and/or wrist when worn. In one embodiment, the compress material is comprised of nylon and spandex. In such embodiments, the percentage of spandex used can vary in relation to the amount of compression desired. In one embodiment, the compress material is comprised of approximately 80% nylon and 20% spandex. In one such embodiment, the spandex used is LYCRA™ spandex. The compress material can be configured such that it is thin and form-fitting to the hand. This can provide comfort by helping to prevent binding of the hand, bunching of the material, and undesired pressure points. The compress material can also be configured to be seamless or nearly seamless for avoiding undesired pressure points. The compress material can also be configured to be air permeable. The compress material can also include a wicking lining for avoiding moisture buildup. The compress material can be configured to be lightweight.

The compress material 14 can be sized to fit a hand such that it encloses the hand and/or wrist and provides compression to the hand. A system of providing gloves of various sizes can be implemented for accommodating hands of various sizes.

The compress material 14 can also be configured to provide compression to the surface tissues along multiple axes of the compress material. For example, as shown in FIGS. 2 and 3, the compress material can be configured to stretch and compress both longitudinally, indicated generally at 34, and latitudinally, indicated generally at 38. This can be beneficial in providing increased comfort and cause desired effects in connection with compression and massaging action.

The gripping surface 18 can be comprised of a leather. In other embodiments, the gripping surface can be comprised of a synthetic leather. The gripping surface can be comprised of a material having tacky, soft, flexible, and/or non-bulky characteristics. A tacky gripping surface can improve grip on many objects 70, such as a racquet. A soft gripping surface can provide comfort and the desired tactual sensations. A flexible gripping surface reduces impediment to movement during activities and helps the gripping surface to conform to the surface of the object 70 being gripped. A non-bulky gripping surface helps prevent bunching, binding, and pressure points, and can improve tactual sensations and reduce impediment to movement. The gripping surface can also be configured to be thin. These features can be desired in performance athletic gloves.

In one embodiment, the gripping surface 18 is comprised of cabretta leather. In other embodiments, the gripping surface can be comprised of sheepskin leathers, digital sheepskin, deerskin leather, calfskin leather, microsuede, and/or other similar leathers or synthetic leathers known in the art. The gripping surface may be configured of other materials known in the art for providing the desired grip on a particular object.

Figure 4:
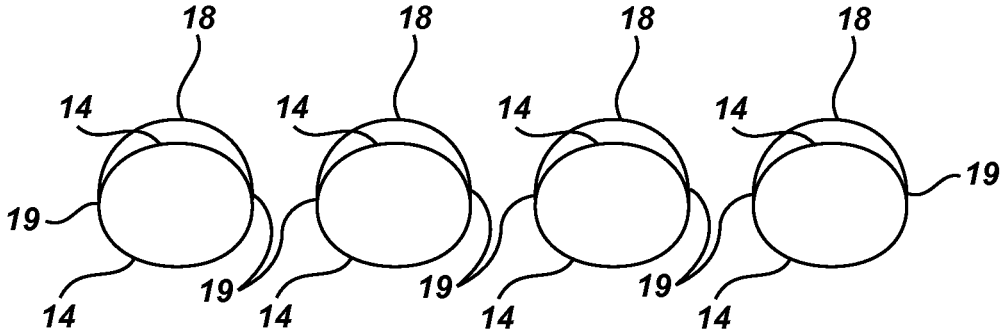
FIG. 4 is a sectional view of the glove of FIG. 2 taken along line 4-4 in FIG. 2.
Figure 5:
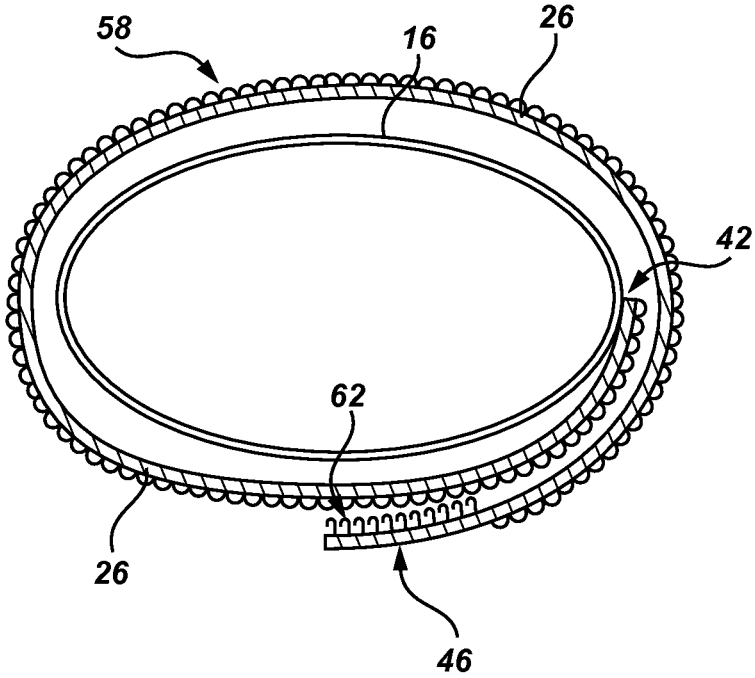
FIG. 5 is a bottom view of the glove of FIG. 2, showing the wrist strap affixed in a wrapped position.
Figure 6:
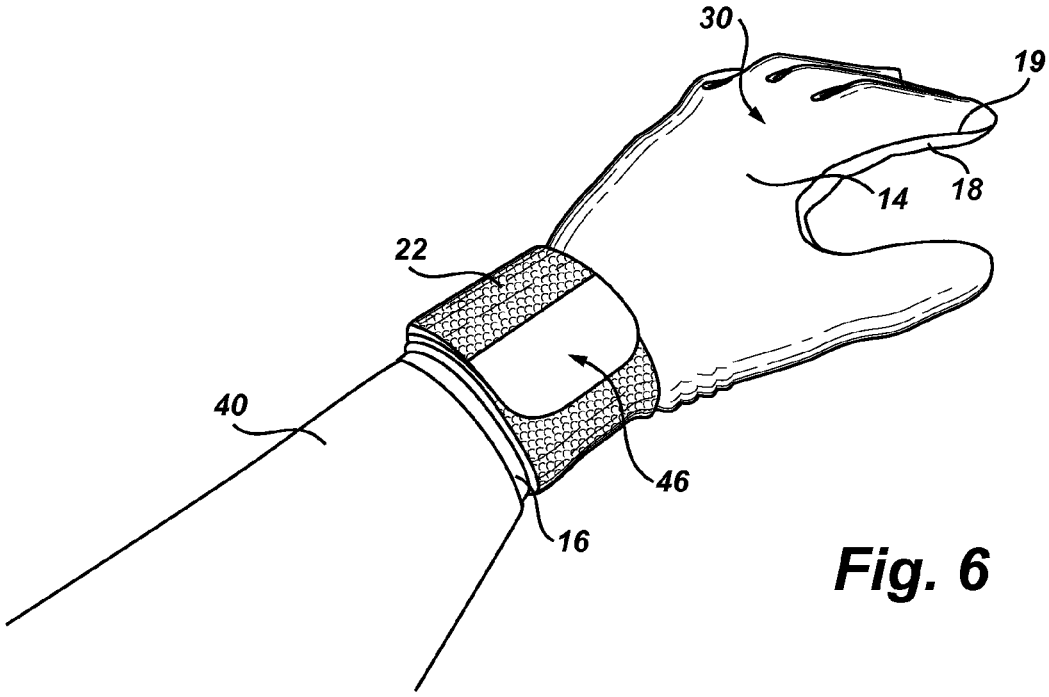
FIG. 6 is a dorsal perspective view of a glove worn by a person in accordance with an embodiment of the present invention.
Figure 7:
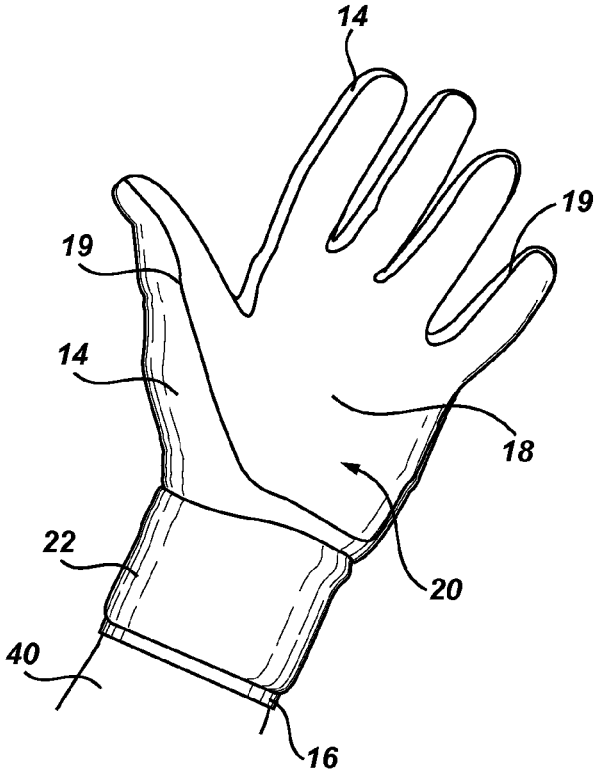
FIG. 7 is a palmar perspective view of a glove worn by a person in accordance with an embodiment of the present invention.

As shown in FIG. 2, in some embodiments, the gripping surface 18 can cover the entire palmar side 20 of the hand. This can sometimes be desired to provide a generally uniform gripping surface against an object 70 being held, which can provide increased comfort. In other embodiments, the gripping surface can be configured to cover specific contact points. As shown in FIG. 4, the gripping surface can be affixed to and over the compress material 14. This can provide the benefit of compression under the gripping surface. In embodiments having the gripping surface over the compress material such as is shown in FIG. 4, the gripping surface can be configured to be tightly-fitted against the compress material when worn by a person 40. This can help to prevent bunching of the gripping surface.

In one embodiment, the gripping surface 18 is affixed to the compress material 14 by stitching the perimeter 19 of the gripping surface to the compress material. Stitching on the perimeter of the gripping surface can avoid discomfort that would be otherwise caused by seams on contact points of the gripping surface when a person 40 holds an object 70. In another embodiment, only the perimeter of the gripping surface is affixed to the compress material. Leaving the interior of the gripping surface unaffixed can allow the compress material under to gripping surface to freely stretch and compress. This can allow for compression of a hand under the gripping surface and improve comfort. Additionally, leaving the interior of the gripping surface unaffixed may be beneficial in helping wick perspiration away from the palm of a hand. In other embodiments, additional stitching in periodic locations across the gripping surface, such as across the base of the thumb joint, can provide for better attachment to the compress material.

The gripping surface 18 can be configured with at least one thickened area. A thickened area can provide additional protection and comfort to the corresponding region of a hand. A thickened area may also help absorb shock and provide additional wear resistance to areas that are likely to receive more wear.

In some embodiments, the glove 10 can further comprise at least one padding element. This padding element can be placed between the compress material 14 and the gripping surface 18.

In embodiments having a wrist support 22, as shown in FIGS. 1-3, 5, 6, and 7, the wrist support can be configured to provide support to a wrist. The wrist support can include a length of strap material 26 sufficient to wraparound a wrist such that the strap material is at least partially overlapping, and also includes a means for affixing the strap material in a wrapped position. In some embodiments, the strap material can be an Ace-style bandage for wrist support. The strap material can have a near end 42 that is affixed to the compress material 14 and a distal end 46. In one embodiment, the near end can be permanently affixed to the compress material. In a more detailed embodiment, the near end can be stitched along a portion of the extended compress material that covers the wrist. The distal end can be configured to be firmly wrapped around the wrist such that the distal end overlaps the near end. The distal end can be configured to affix the strapped material in a wrapped position.

The strap material 26 can be configured to be elastic along its length 50 or the latitudinal axis, indicated generally at 38 of FIGS. 2 and 3. This elasticity can provide compression to the wrist. In one embodiment, the strap material is comprised of a neoprene blend configured to be elastic along the latitudinal axis. In some embodiments, the width 54 or longitudinal axis, indicated generally at 34 of FIGS. 2 and 3, of the strap material can be configured to have little or no elasticity. The lack of elasticity along the width 54 of the strap material (or longitudinal axis) may provide more support to wrist.

The strap material 26 can also be configured to be adjustably tightened along the latitudinal axis 38. In one embodiment, a Velcro-style hook and loop fastener can be used for affixing the strap material in an adjustably-tightened wrapped position. In a more detailed embodiment, the strap material can have an outer side 58, as shown in FIG. 2, at least a portion of which is configured with a loop portion of the Velcro-style hook and loop fastener; and the strap material also has an inner side 62, as shown in FIG. 3, at least a portion of which is configured with a hook portion of the Velcro-style hook and loop fastener at or near the distal end 46 of the strap material. In such an embodiment, the inner side can affix to the outer side at various places along the length of the outer side for adjustably tightening the wrist support. The compression of the strap material can be adjusted by tightening or loosening the wrist support.

The length 50 of the strap material 26 can be equal to or greater than about 7 inches. In one embodiment, the length of the strap material is about 11 inches. The width 54 of the strap material can be equal to or greater than about 1 inch. In one embodiment, the width of the strap material is about 2 inches.

A glove of the present invention can be configured to specifically enclose and compress a right hand. Alternatively, a glove of the present invention can be configured to specifically enclose and compress a left hand. Such embodiments can provide better fit.

Additionally, a glove of the present invention can comprise a multi-handed configuration to accommodate a person wearing the glove on either a right or a left hand. This can allow a single glove to fit either hand, such that the glove can be worn on either a right hand or a left hand. In some multi-handed configured glove embodiments, the palmar side of the glove can depend on which hand the glove is worn on. For example, if a multi-handed glove has a single thumb position, the palmar side of the glove when worn on the left hand can be the dorsal side of the glove when worn on the right hand, and vice-versa. In multi-handed glove embodiments, the glove can have a gripping surface on at least a portion of both sides of the glove such that there is a gripping surface on at least a portion of the palmar side and on at least a portion of the dorsal side of the glove. Such multi-handed glove embodiments can allow a person using the glove to alternate the gripping surface of the gloves. For example, if a user had a pair of such multi-handed gloves, he could switch the gloves to the alternate hands after prolonged use. This may help lengthen the life of the gripping surface. Additionally, such multi-handed glove embodiments can have marketing benefits such as not having to display and stock both right-handed and left-handed gloves.

The invention also provides a method for therapeutically benefitting a hand and providing a means to grip an object, comprising the steps of compressing at least a portion of the hand with a compress material 14 and affixing a gripping surface 18 to the compress material. The gripping surface can be located on the palmar side of the glove. The gripping surface can also be located on both the palmar and dorsal sides of the glove, as can be the case in multi-handed embodiments. The invention can further provide for supporting the wrist with a length of strap material 26 sufficient to wraparound the wrist, such that the strap material is at least partially overlapping, and has a means for affixing the strap material in a wrapped position.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A therapeutic activity glove having a palmar side and a dorsal side, comprising:

a) a compress material configured to enclose and compress all surface tissues of a hand and a wrist attached to the hand;

b) a gripping surface affixed to and over at least a portion of the palmar side of the glove, wherein the gripping surface is comprised of a material comprising the following characteristics: 1) tacky; 2) soft; 3) flexible; and 4) non-bulky; and c) a wrist support configured to support the wrist, wherein the wrist support includes a length of strap material configured to wraparound the wrist such that the strap material is at least partially overlapping and also includes a means for affixing the strap material in a wrapped position, and wherein the strap material is configured to be elastic along the latitudinal axis and is also configured to be adjustably tightened along the latitudinal axis.

* * * * *